US007168106B2

(12) United States Patent
Pantos et al.

(10) Patent No.: US 7,168,106 B2
(45) Date of Patent: Jan. 30, 2007

(54) CAM-ACTUATED TOILET SEAT LIFTING DEVICE

(76) Inventors: William P. Pantos, 1549 San Elijo, Cardiff, CA (US) 92007; Curtis Sword, 1549 San Elijo, Cardiff, CA (US) 92007

( * ) Notice: Subject to any disclaimer, the term of this patent is extended or adjusted under 35 U.S.C. 154(b) by 0 days.

(21) Appl. No.: 11/187,252

(22) Filed: Jul. 25, 2005

(65) Prior Publication Data

US 2006/0143812 A1 Jul. 6, 2006

Related U.S. Application Data

(63) Continuation-in-part of application No. 10/979,039, filed on Nov. 2, 2004, now Pat. No. 6,934,974.

(60) Provisional application No. 60/640,537, filed on Dec. 30, 2004.

(51) Int. Cl.
*A47K 13/10* (2006.01)

(52) U.S. Cl. ..... 4/246.1; 4/241; 4/248

(58) Field of Classification Search ..... 4/241, 4/246.1, 246.3–246.5, 248
See application file for complete search history.

(56) References Cited

U.S. PATENT DOCUMENTS 2,705,330 A * 4/1955 Knudsen ..... 4/246.1
5,444,877 A * 8/1995 Kumarasurier ..... 4/246.1

* cited by examiner

*Primary Examiner*—Tuan Nguyen
(74) *Attorney, Agent, or Firm*—John R. Ross; John R. Ross, III

(57) ABSTRACT

A toilet seat lifter means is described, using a minimally simple lever and cam means with a counterweight balanced action arm. The device is adaptable to all standard toilets available today, an improved version of these inventor's prior invention. The new lifter offers a minimum number of moving parts and no springs or pulleys, is easier to manufacture and assemble, and possesses improvements to support the needs of disabled individuals.

4 Claims, 4 Drawing Sheets

CAM-ACTUATED TOILET SEAT LIFTING DEVICE

RELATED U.S. APPLICATIONS

This application supplements and completes Provisional Application 60/640,537, filed Dec. 30, 2004. This application is a continuation-in-part of Ser. No. 10/979,039 filed Nov. 2, 2004 (which issued as U.S. Pat. No. 6,934,974 on Aug. 30, 2005).

FIELD OF THE INVENTION

This invention relates to toilet appliances having to do with lifting or adjusting the toilet seat position. The field contains several toilet seat adjusters with a variety of mechanical means, including an earlier invention by these inventors, "Force Adjustable Toilet Seat Lifting and Lowering Mechanism", U.S. patent application Ser. No. 10/979,039, to be issued in 2005.

BACKGROUND OF THE INVENTION

This is a simplified method for raising and lowering a standard toilet seat without touching the seat with the hands. It is compatible with and can be retrofitted to all standard toilets without requiring specialized seat assemblies. The mechanical implementation minimizes or eliminates springs, friction, ratchets, and gears and has a unique design that requires simpler counterweighting as well as a crutch receptacle, improvements over these inventors' previous design.

The state of the art is replete with competing designs, most of which are of limited practicality and usefulness. Jackson in U.S. Pat. No. 6,738,990 teaches a pedal operated lifter that uses a complex support framework and pulleys. Joseph in U.S. Pat. No. 5,875,498 uses pulleys and springs for a pedal-operated system, a solid framework attached to the floor. Kumarasurier in U.S. Pat. No. 5,444,877 shows a pedal-operated system with ratcheted gears and interior bearings that is not adjustable with a counterweight. Wolfer in U.S. Pat. No. 5,280,654 presents a system that is superficially similar to the present invention, but does not fit standard toilet seats and possesses an inferior lever action. The remainder of the art is substantially distinct from this invention, with the exception of the aforementioned invention by these inventors.

OBJECTS OF THE INVENTION

It is an object of this invention to provide a toilet seat lifter that requires no use of the hands to operate, and especially thereby improving personal hygiene.

It is a further goal of this invention to produce this device with the minimum number of moving parts.

It is a further goal of this invention to implement this toilet seat lifter with no parts that can wear out easily and require continuous replacement.

It is a further goal of this invention to reduce friction in the system and provide a counterweighted foot pedal that will minimize the force necessary to lift and lower a toilet seat with this device.

It is also a goal of this invention to control the speed with which a toilet seat lifts and lowers, preventing damage to the toilet seat and minimizing noise.

SUMMARY OF THE INVENTION

The mechanism is an extruded or stamped metal housing which connects to the toilet. The housing possesses two interlocking, variable ratio cams, the cams attached to two separate lever arms, one short and connected to a toilet seat, the other arm long and extending towards the floor.

The longer lever arm has a counterweighted pedal that helps regulate the speed of the toilet seat lowering and raising. The cams are designed so that the combination of cams and lever arm placement prevents the toilet seat from hitting the back of the toilet when raised and prevents the toilet seat from slamming onto the toilet when lowered.

The hardware is under the seat and out of sight of the user. This invention can be installed on the left or right side of any toilet.

The significant improvements of this device over its predecessor include the cams substituted for the earlier gears, the replacement of the clip attached to the seat underside with a slot in the seat itself, and the improved clearance control between the seat and the toilet tank. In particular, the substitution of cams for gears makes for a more solid connection between the action arms, reduces slippage and mechanical friction, while reducing manufacturing and assembly costs.

BRIEF DESCRIPTION OF THE DRAWINGS

The features of this invention will be best understood from the accompanying drawings, taken in conjunction with the accompanying description.

DESCRIPTION OF THE PREFERRED EMBODIMENT

Figure 1:
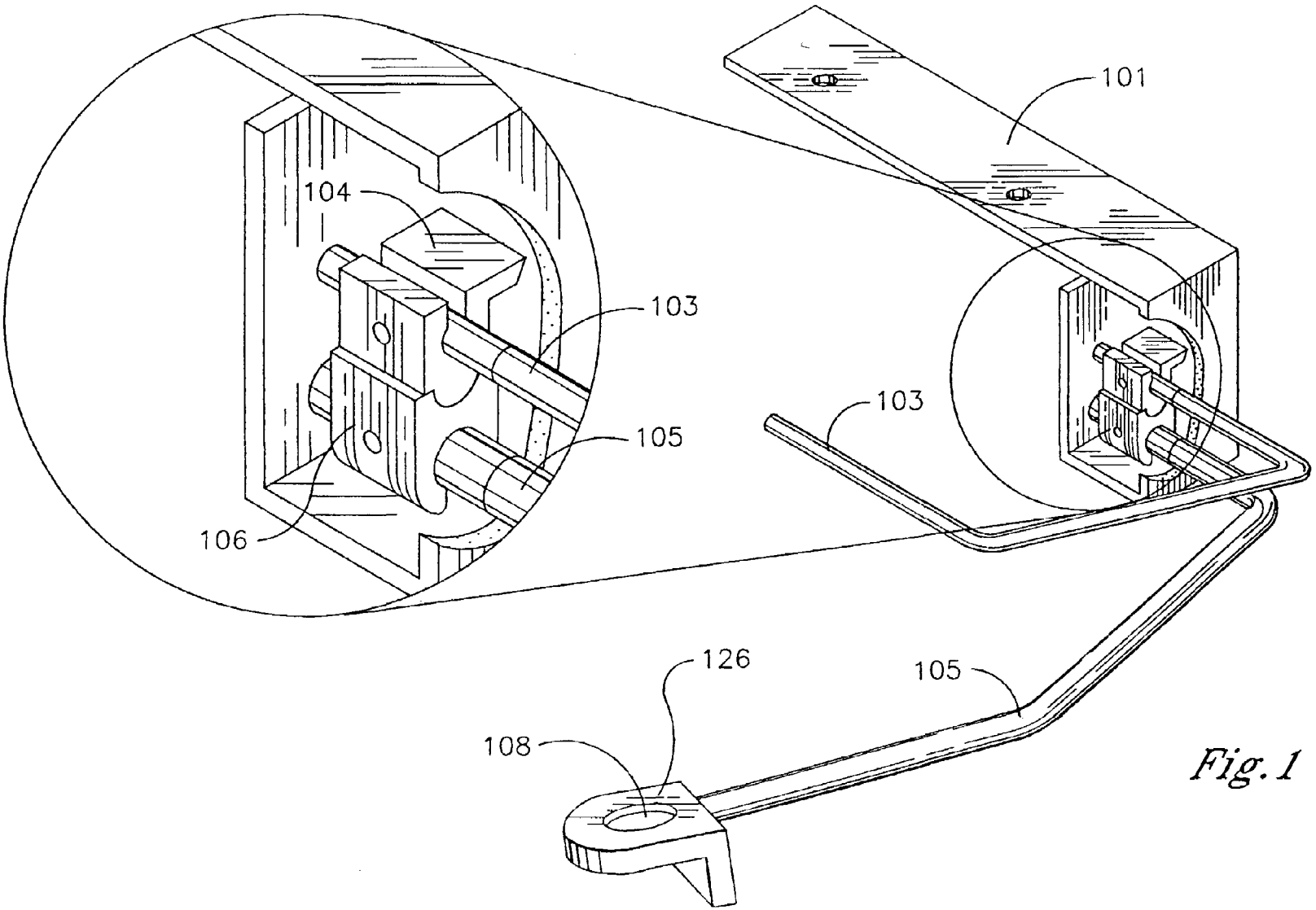
FIG. 1 is a perspective and expanded view of the invention

The invention can be seen best in FIG. 1, and it consists of a housing 101, a small lever arm 103 connected to an upper cam 104, a large lever arm 105 connected to a lower cam 106, the two cams 104,106 and arms 103,105 held within the housing by means of lever entry holes 107.

Figure 2:
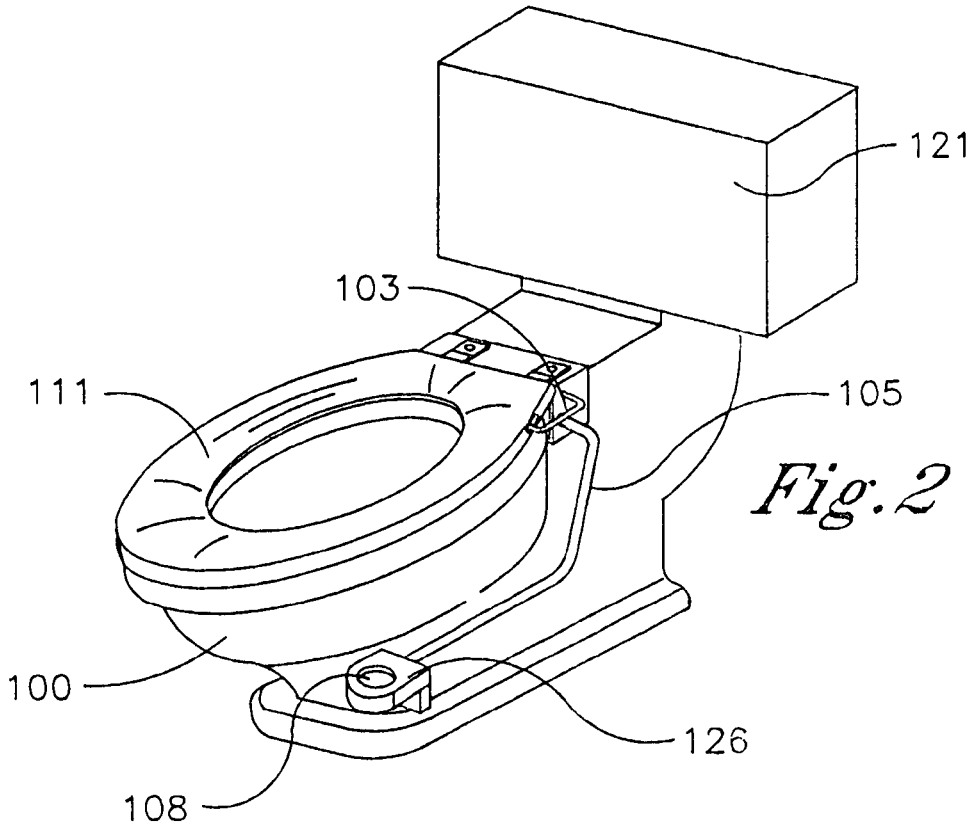
FIG. 2 is view of the invention attached to the toilet, seat down
Figure 3:
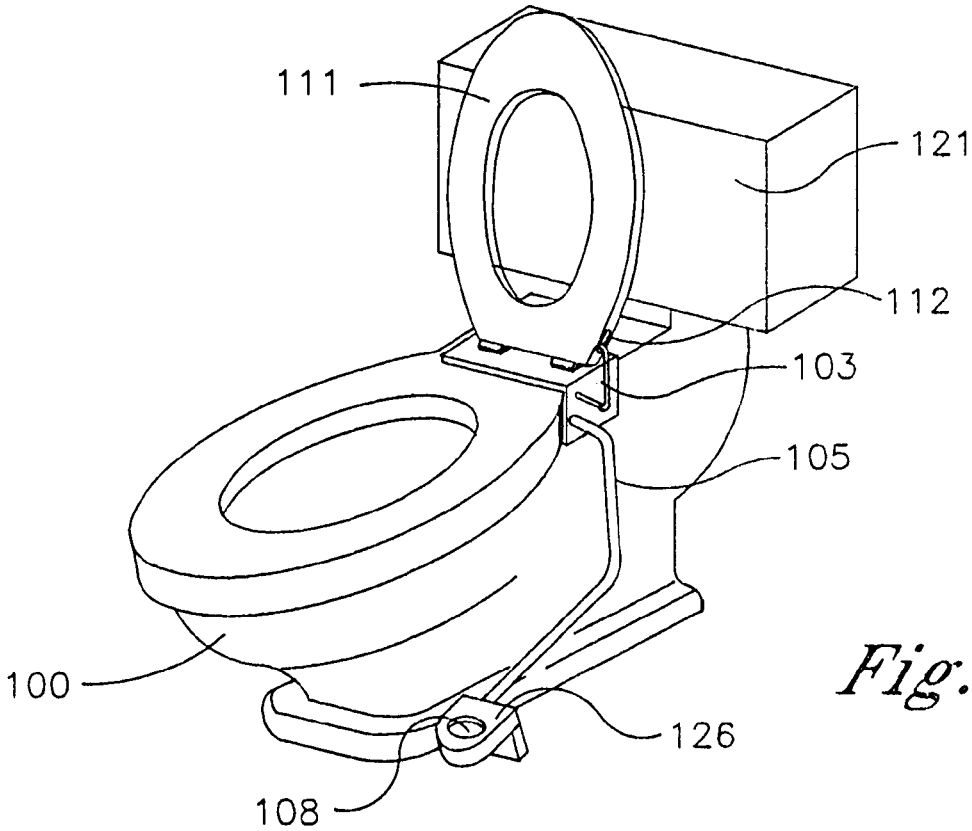
FIG. 3 is a view of the invention attached to the toilet, seat up
Figure 4:
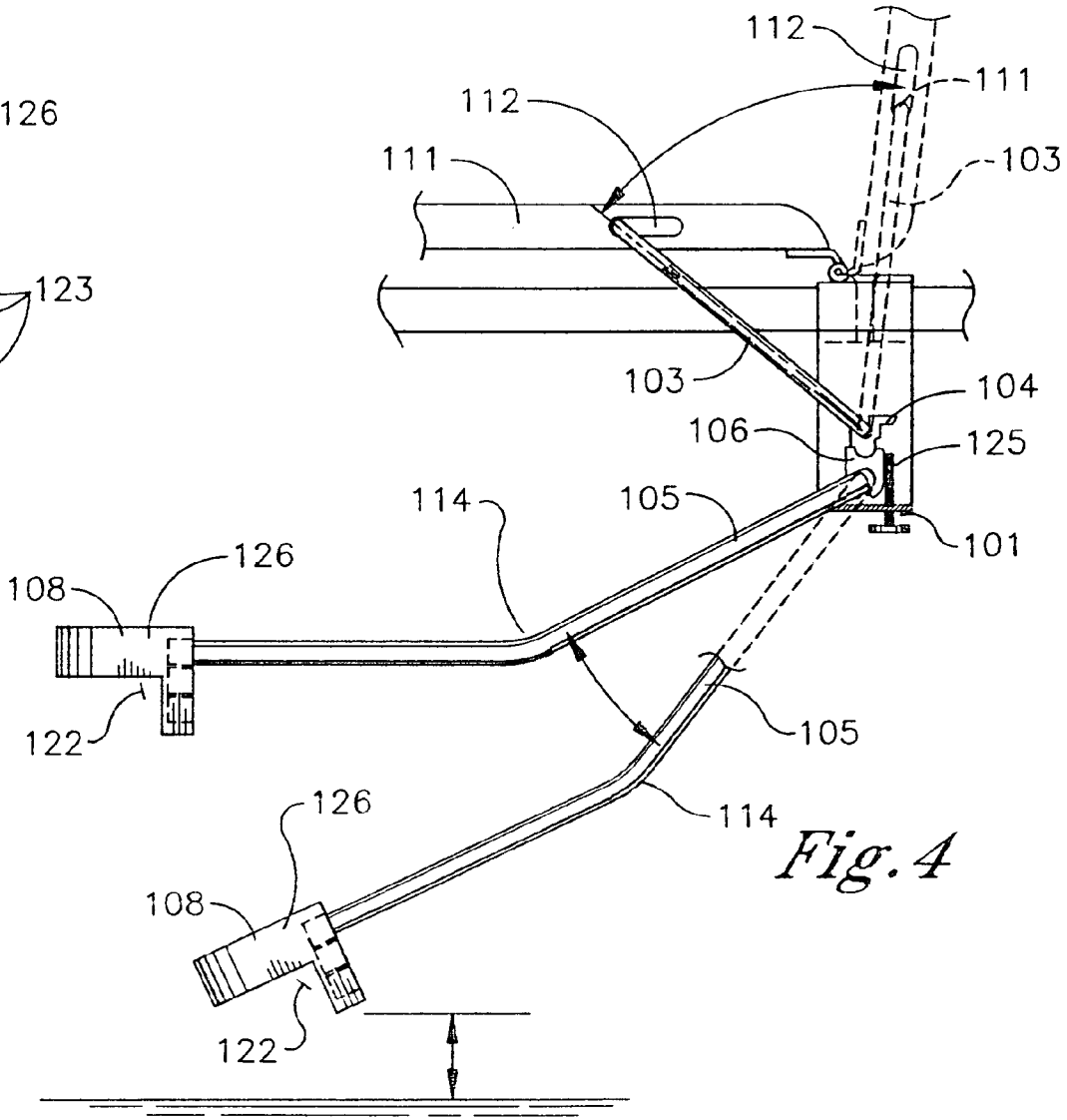
FIG. 4 is a side view of the invention in action
Figure 5:
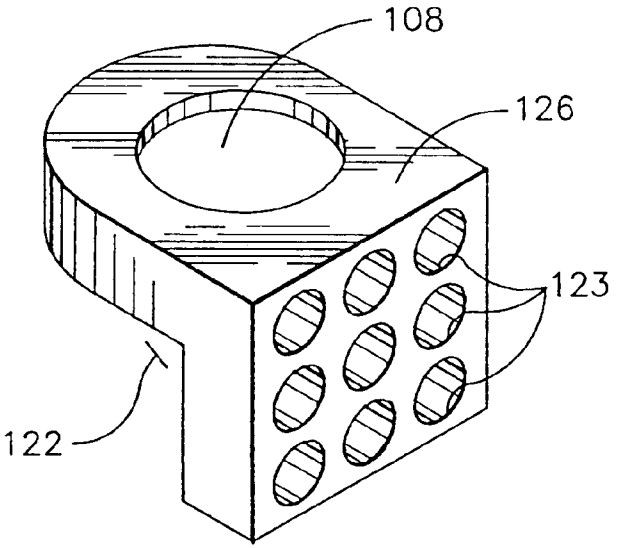
FIG. 5 is a perspective view showing the pedal configuration

The large lever arm 105 extends away from the housing 101 alongside a toilet 100 towards the floor, as in FIG. 2 and FIG. 3, and possesses a counterweighted pedal 126 with a crutch/cane receptor 108. As seen in FIG. 3, the small lever arm 103 is inserted into the side of the toilet seat 111 by means of an attachment slot 112. As can be seen in FIG. 4, by means of this slot 112, the seat 111 can be raised by pressing with the foot on the pedal 126 at the end of the large lever arm 105, and lowered by lifting the pedal 126 with the foot placed in the pedal recess 122.

Figure 8:
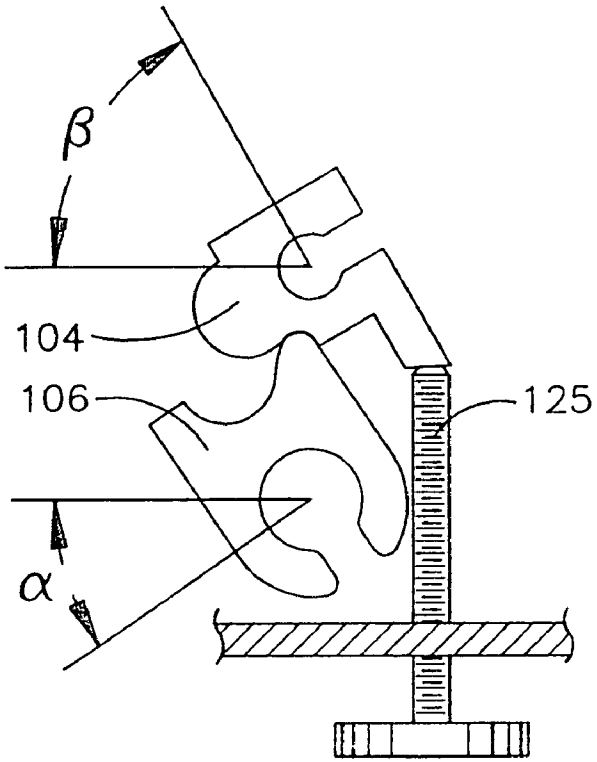
FIG. 8 is a cross-section of the cam assembly with seat up
Figure 7:
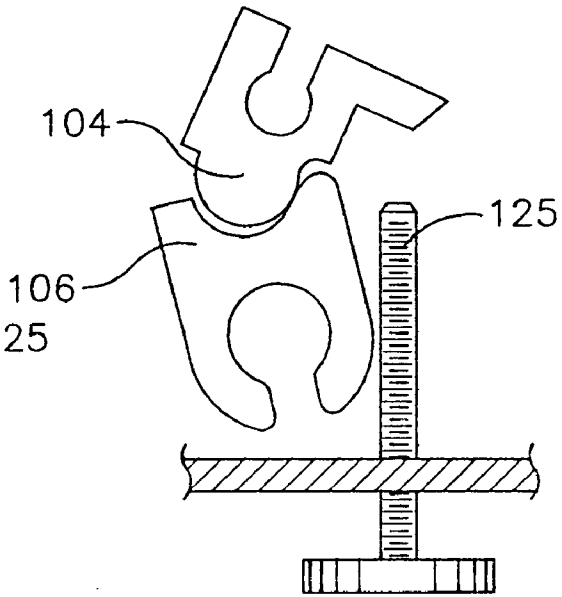
FIG. 7 is a cross-section of the cam assembly with seat half up
Figure 6:
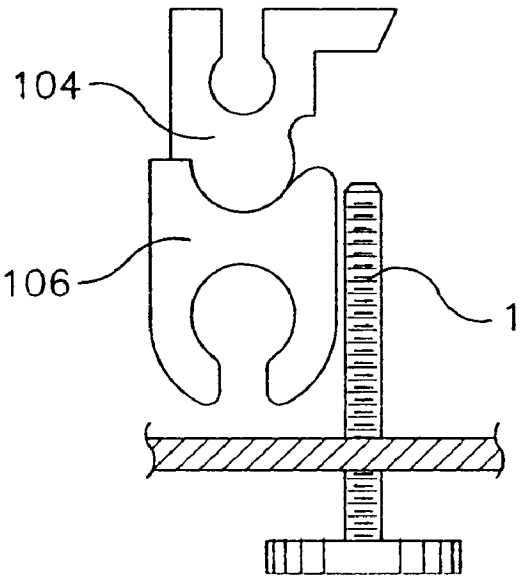
FIG. 6 is a cross-section of the cam assembly with seat down

When the seat 111 is lifted, the small lever arm 103 slides from one end of the attachment slot 112 to the other, allowing the seat 111 to be lifted through angle β with only a small angular rotation α of the large lever arm 105. This angular rotation is shown in FIGS. 6,7, and 8.

Looking at FIG. 4, there is a thumbwheel screw 125 that passes from the outside into the interior of the housing 101. This thumbwheel screw 125 is used to control the stopping position of the small lever arm 103 as the seat is raised to prevent the seat 111 from hitting the toilet tank 121.

The pedal 126 is shaped to permit a space 122 under the upper surface of the pedal to position the foot for lifting the pedal 126. The pedal possesses a multiplicity of holes 123 that permit the insertion of the large lever arm 105. By means of choosing which hole 123 in which to insert the large lever arm 105, the distance above the ground the pedal 108 rests when the toilet seat 111 is raised can be adjusted. The top of the pedal 126 possesses a crutch/cane receptacle 108 that will accommodate the tip of a crutch or cane, making it easier to depress the pedal for handicapped individuals.

While the foregoing describes a preferred embodiment, variation on this design and equivalent designs may be resorted to in the scope and spirit of the claimed invention.

The invention claimed is:

1. A toilet seat lifter, comprised of a housing, a small lever arm, a large lever arm, an upper cam, a lower cam, and a seat lift adjustment means, the housing capable of being attached to a standard toilet underneath the placement of the toilet seat, the housing using the standard-equipment toilet seat bolts to hold it to the toilet, the upper cam and lower cam connected by physical engagement, the small lever arm connected fixedly to the center of rotation of the upper cam, the large lever arm connected fixedly to the center of rotation of the lower cam, the small and large lever arms bent in such a manner that the motion of the large lever arm rotates the lower cam and by means of physical engagement the lower cam rotates the upper cam, the motion of the upper cam rotates the small lever arm, the small lever arm inserted into an attachment slot in the side of a standard toilet seat, the end of the small lever arm capable of sliding the length of the attachment slot while the seat is lifted, said sliding motion minimizing the angular distance turned by the upper cam, the large lever arm possessing a counterweighted pedal at the end of the large lever arm away from the lower cam, the pedal possessing a multiplicity of insertion holes that are capable of receiving the end of the large lever arm, the distance the pedal stops above the ground when the pedal is depressed adjustable by means of selecting an appropriate hole in which to insert the large lever arm, the pedal held removably on the end of the large lever arm, the large lever arm extending from the housing behind the standard toilet seat towards the floor without contacting the floor, the toilet seat lifter operated by attaching the housing behind the toilet seat such that one end of the small lever arm is inserted into the attachment slot in the side of the standard toilet seat, the large lever arm extending alongside the toilet stool towards the floor, the seat lifted by pressing down the pedal at the end of the large lever arm with the foot until the toilet seat is all the way up, the seat lowered by lifting the pedal with the foot until the toilet seat starts towards the down position.

2. The toilet seat lifter of claim 1 where the housing is comprised of extruded or stamped aluminum.

3. The toilet seat lifter of claim 1 where the seat lift adjustment means is a screw inserted from the outside of the housing extending into the interior of the housing, the screw possessing a thumbwheel top, the screw capable of setting the up position of the toilet seat by stopping the upper cam at an appropriate point in its revolution.

4. The toilet seat lifter of claim 1 where the pedal possesses a receptacle on its upper surface, said receptacle capable of receiving and holding the bottom end of a cane or a crutch.

* * * * *